US005215400A

United States Patent [19]

Hugron

[11] Patent Number: 5,215,400

[45] Date of Patent: Jun. 1, 1993

[54] DISCONNECTABLE BASE SUPPORT ASSEMBLY FOR ROADWAY SIGNS

[76] Inventor: Denis P. Hugron, 1855, Georges, St-Hubert, Quebec, Canada, J4T 1W2

[21] Appl. No.: 897,948

[22] Filed: Jun. 15, 1992

[51] Int. Cl.[5] ..... E01F 9/00

[52] U.S. Cl. ..... 404/11

[58] Field of Search ..... 404/6-11

[56] References Cited

U.S. PATENT DOCUMENTS

| | | | |
|---|---|---|---|
| 1,662,298 | 3/1928 | Corey | 404/11 |
| 1,728,687 | 9/1929 | Matthews | 404/11 X |
| 2,045,419 | 6/1936 | Smith | 404/11 |
| 4,762,439 | 8/1988 | Carlyle | 404/11 X |

*Primary Examiner*—Thuy M. Bui
*Attorney, Agent, or Firm*—Roland L. Morneau

[57] ABSTRACT

A quick disconnectable base support assembly for roadway sign is adapted to facilitate the removal of a sign post from a ground retaining foundation. The assembly comprises a C-shape bracket adapted to be horizontally secured to ground retaining foundation. The bracket has a flat face and two terminal flanges at each end extending one towards the other over the flat face. The plate is slidingly mounted in the bracket which has a spring leaf under one of the flanges to abut the plate against the other end of the bracket. A brace member is secured on the flat plate and is provided with an attachment for holding a sign post. With such an arrangement, the sign post can be quickly disconnected from the ground retaining foundation into which the bracket is set. This arrangement allows the transportation and storing of the sign post without any of the usual base member which are heavy and cumbersome.

7 Claims, 3 Drawing Sheets

DISCONNECTABLE BASE SUPPORT ASSEMBLY FOR ROADWAY SIGNS

BACKGROUND OF THE INVENTION

1. Field of the Invention

The present invention is directed to a support for roadway signs and in a particular to a support which can be quickly disconnected from a ground retaining foundation so as to free the roadway from any hindrance when the sign is removed.

2. Prior Art

Many roadway signs are needed for specific periods of time but need to be held to the ground firmly when in use. Some of those signs are provided with a rigid, heavy base which needs to be transported on location and removed and carried away when its purpose has ended. The transportation of such heavy and voluminous base is expensive.

Other roadway signs need to be frequently and periodically put in place and removed when the traffic is heavy or light or when the conditions of the road require specific identification for definite periods of time.

In most of these cases, the signs need to be generally removed for most of the time and accordingly, the surface of the road needs to the free of hindrance which may cause accidents or damages to the cars.

A search of the prior art has revealed only one patent which relates to a collapsible roadway signal assembly. U.S. Pat. No. 4,177,749 to Henry Lindner involves a disk member which is adapted to pivot about an axis and is adapted to be demountable. This assembly has a different structure than the one presently disclosed and claimed.

SUMMARY OF THE INVENTION

The present invention is directed to a disconnectable base support assembly for a roadway sign which allows a quick disconnection of the roadway sign from a ground retaining foundation. The assembly includes a C-shaped bracket having a flat face and two terminal flanges at each end of the bracket, each flange extending one towards the other over the face of the bracket. The bracket and in particular the face is adapted to be horizontally secured to a ground retaining foundation in a permanent manner and receding inside the ground retaining foundation. A plate is mounted in the bracket and extends over the flat face of the bracket and below both flanges. The plate has a thickness for allowing it to slide on the flat face under the flanges. It has a minimum length for allowing the plate to be maintained on the flat face of the bracket by the flanges. The plate has also a maximum length corresponding to the length of the bracket minus the width of one of the flanges for allowing retraction of the plate from the bracket when the plate is pushed in the direction of the other flange. A resilient member is mounted on the bracket under one of the flange for biasing the plate in the direction of the other flange. A pedestal is fixed on the plate for supporting a post on which a traffic signal will be fastened. Such an arrangement allows the post to be quickly disconnected from the bracket which is held by the ground retaining foundation.

One of the flanges is preferably longer than the other and provided with a curved leaf spring adapted to firmly abut the plate in the direction and under the other flange.

Another characteristic consists in a brace member secured on the plate on which a post may be fastened, the post being removable with the plate from the bracket to leave the roadway free from any objectional hindrance.

DETAILED DESCRIPTION OF THE INVENTION

Figure 1:
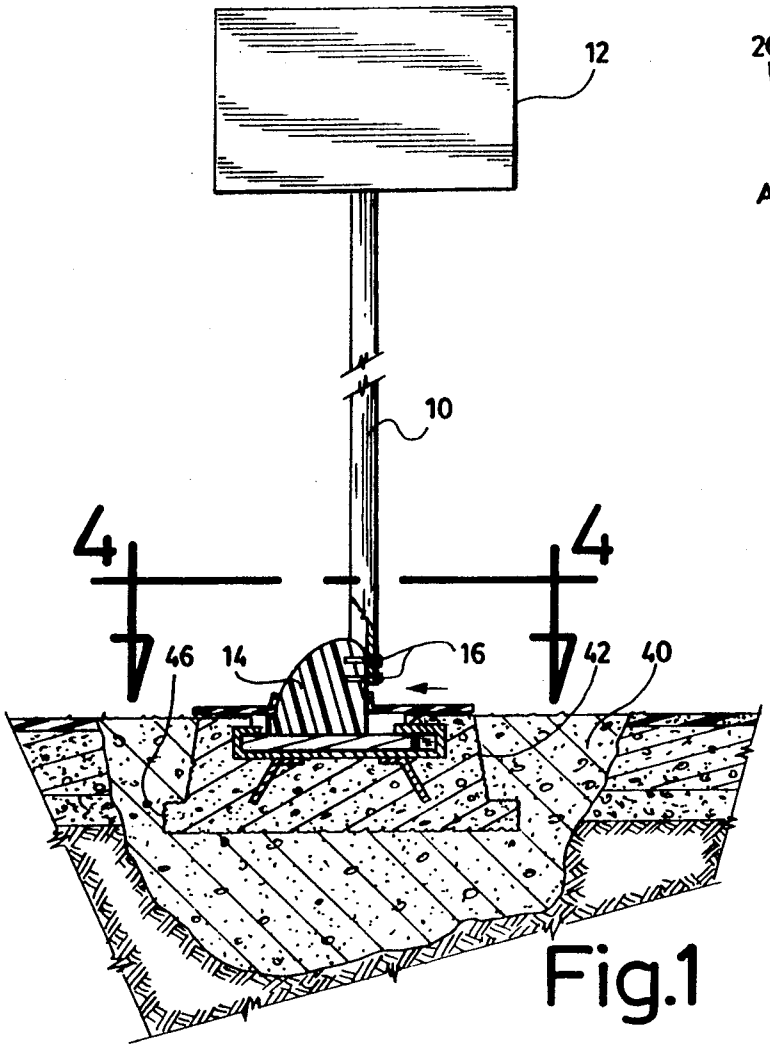
FIG. 1 is a vertical cross-sectional view of the disconnectable base support assembly according to the invention, the assembly supporting a post and a sign.
Figure 6:
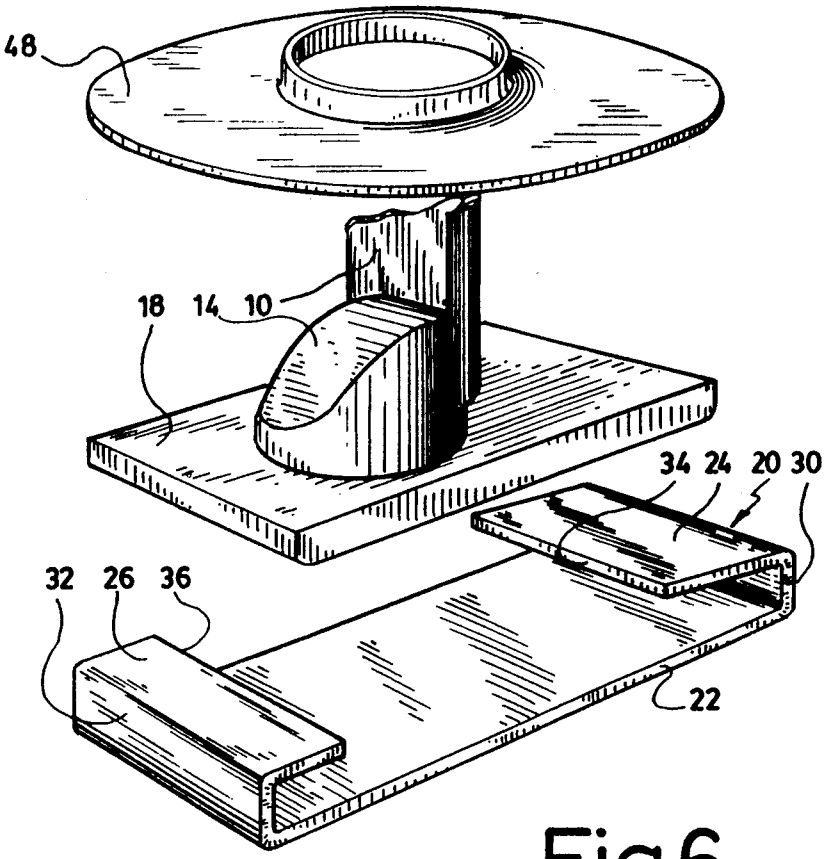
FIG. 6 is an exploded view of the components adapted to support the post.

FIG. 1 illustrates a post 10 supporting a sign 12. The post 10 is secured in an upright position to a brace member 14 by a pair of bolts 16. The brace member 14 is secured to a flat plate 18 slidingly mounted in a rectangular bracket 20 defining substantially a C-shape. Bracket 20 has a horizontal flat face 22 and two terminal flanges 24 and 26 extending one towards the other and above the flat face 22.

Figure 2:
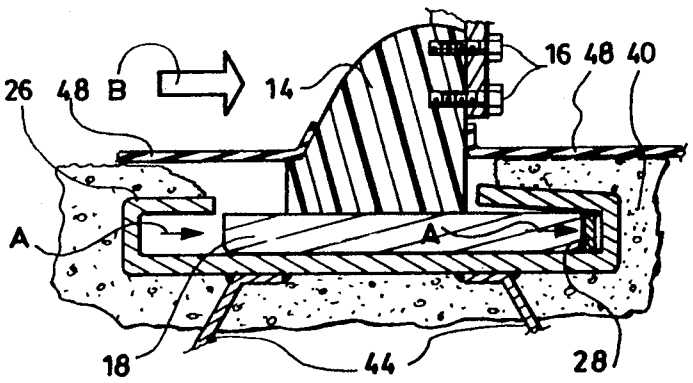
FIG. 2 is an enlarged view of the disconnectable base support assembly shown in FIG. 1.

A curved leaf spring 28 is located under the flange 24 over the face 22 and both ends of the curved spring 28 abuts against the edge 32. The plate 18 is rectangular and is adapted to slide on the flat face 22, under both flanges 24 and 26. The plate 18 has a length which, when mounted inside the bracket 20, will extend between the edge 32 and the leaf spring 28 and be abutted firmly on the edge 32 by the spring 28. The thickness of the plate 18 corresponds to the distance between the flanges 24 and 26 and the flat face 22 so as to freely slide in contact with the flat face 22. The length of the plate 18 must be greater than the distance between the leading edge 34 of the flange 24 and the leading edge 36 of the flange 32 so as to be maintained against the flat face 22 under any normal circumstances. The same plate 18 must have a maximum length which when pushed against the spring leaf 28, in the direction of the arrows A, the edge 38 of the flat plate 18 must not be covered by the flange 26 to allow the insertion of the plate 18 in the bracket 20 when pushed in the direction of the arrow B or its retraction when pulled back in the direction of the arrow C. In other words, the flat plate 18 must have a maximum length which substantially corresponds to the length of the bracket minus the width of one of the flanges and in particular flange 26 illustrated in FIG. 2 of the drawings.

Figure 4:
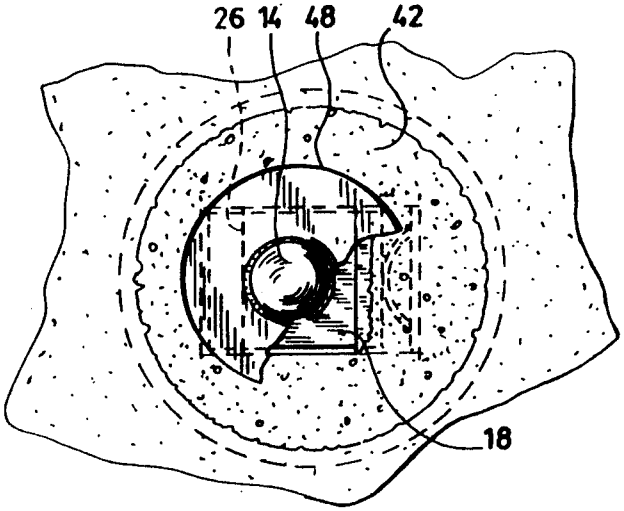
FIG. 4 is a top view of the assembly along line 4—4 of FIG. 1.
Figure 5:
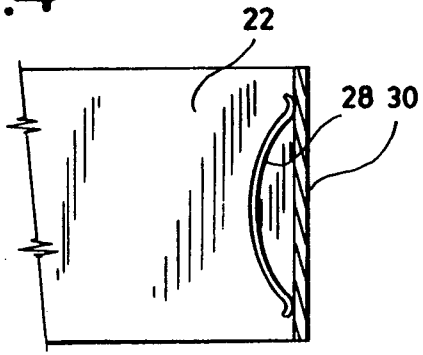
FIG. 5 is a cross-sectional view along line 5—5 of FIG. 3.

The length of the flange 24 is preferably longer to allow the housing of the spring leaf 28 and in particular the length of the flange 24 must be sufficiently long so that when the spring leaf 28 is abutting against the flat plate 18 as shown in FIGS. 1 and 4, the flange 24 will still substantially cover the flat plate 18 to maintain the post 10 well secured to the bracket 20.

The installation of the disconnectable base support assembly is generally performed as follows. The bracket 20 is permanently secured below the pavement as shown in FIG. 1. However, it is preferable to set the bracket 20 in a cement block 42 which will be embedded later into the pavement 40. The block 42 constitutes a ground retaining foundation which makes it easier to mold into the pavement 40 whether the latter is made of cement of asphalt.

In order to accentuate the anchoring retention of the bracket 20 in the block 42, a pair of anchoring legs 44 are provided under the bracket and helps to reinforce the adherence of the bracket inside the block 42. The block per se 42 may also be provided with a rim 46 to prevent it from being forced out of the pavement 40 when the post is hit by a vehicle.

Considering that dirt, snow or ice may have access to the components which must freely slide, an elastomeric membrane 48 is secured around the brace member 14 and extends peripherally over the bracket and around an area sufficiently wide to prevent access of any undesirable debris which could interfere with the free movement of the flat plate 18 inside the bracket 20.

A post 10 and a sign 12 can be quickly disconnected from the ground when the sign is not needed and can also be quickly installed when required. Such an operation may take place at different times of the day when the traffic is heavy such as in the morning or late afternoon or when some regular and frequent modifications of information must be provided to the vehicules passing by. The parts of the novel device which needs to be transported and stored consists only in a set of flat signs 12 upright posts 10 with brace members having a relatively small dimension. On the contrary, the usual temporary signs which are generally used for that purpose, includes a flat upright signboard such as 12, a post and a flat horizontal heavy and large metal baseboard mounted at 90 degrees relative to the upright sign 12. Such an arrangement requires considerable storing space, is heavy to move and frequently requires special machinery to lift them and load them in a truck.

Figure 3:
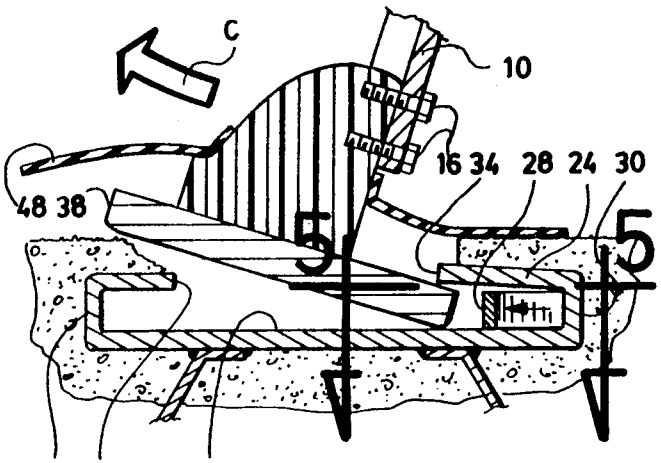
FIG. 3 is a cross-sectional view as shown in FIG. 2 with the sign post in the process of being removed from a bracket secured in a ground retaining foundation.
Figure 7:
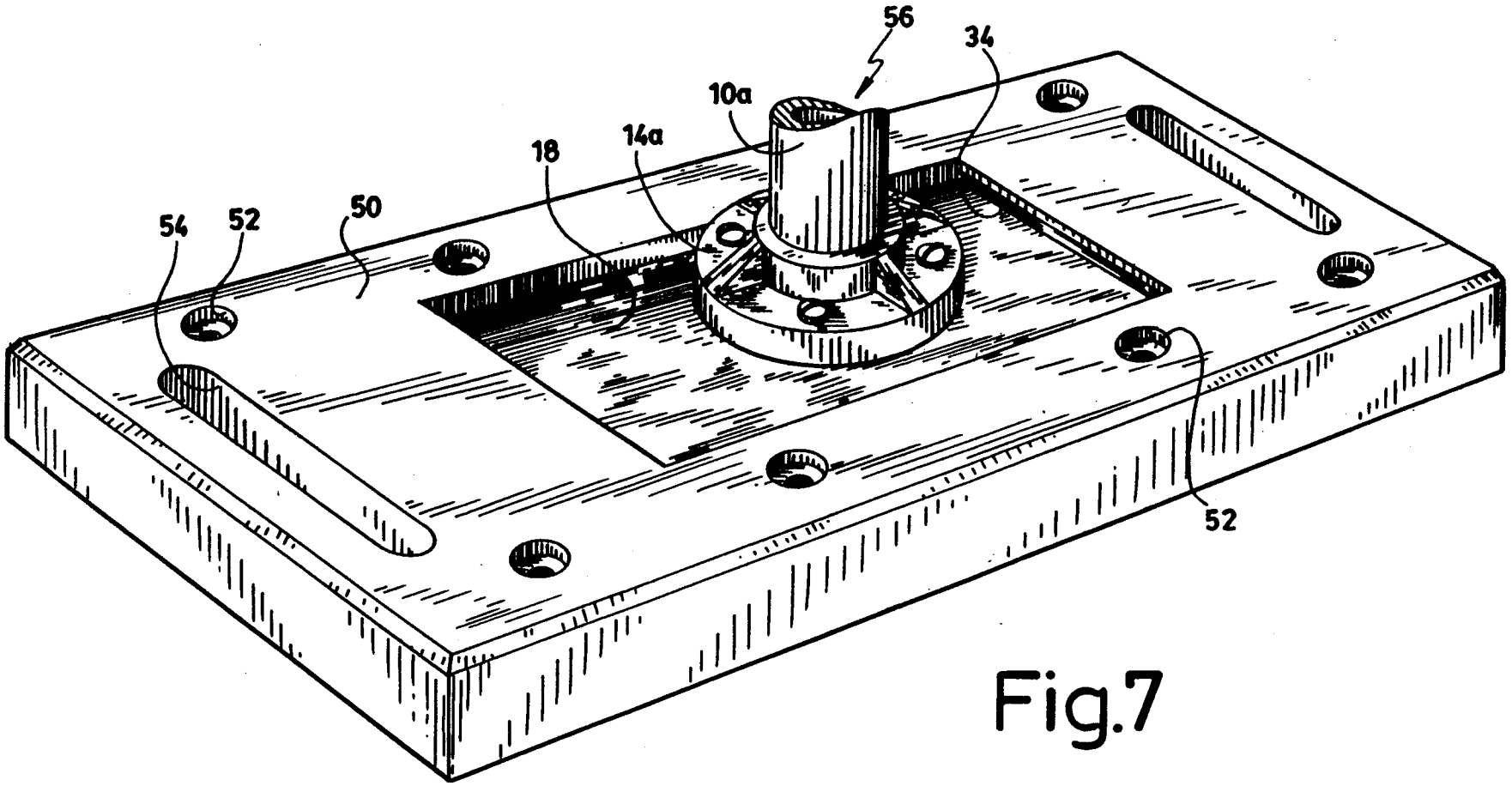
FIG. 7 is a perspective view of the disconnectable base support mounted on a transportable platform.

It is also within the embodiment of the invention to install the bracket 20 and a post assembly 56 in a transportable platform 50 as shown in FIG. 7. The platform 50 is preferably made of synthetic rubber incorporating lead particles. Such a platform having a weight of about 30 to 50 pounds and a high coefficient of friction, cannot be easily displaced by a vehicle hitting the post 10 supported by the brace member 14*a*. The platform has a pair of handles 54 which allows an operator to retrieve the platform and place it in a truck after the post assembly 56 has been disconnected from the platform in the manner shown in FIG. 3. The post assembly 56 can be laid flat in a truck along the platform 50. In the embodiment shown in FIG. 7, the post assembly 56 includes the flat plate 18 on which is mounted a connecting ring 56 with screws and a brace member 14*a* on which the post 10 is to be secured. The flat face 32 of the bracket 20 is embedded on the platform 50 which covers both flanges 24 and 26.

The platform 50 may also be permanently secured to the ground with bolts fixed in the holes 52 provided in the platform.

I claim:

1. A disconnectable base support assembly for roadway signs comprising, a C-shaped bracket having a flat face and two terminal flanges at each end of said bracket extending one towards the other over said face, said face adapted to be horizontally secured on a ground retaining foundation, a plate mounted in said bracket having a thickness for allowing said plate to slide on said face under said flanges, said plate having a minimum length for allowing it to be retained on said face by said flanges, said plate having a maximum length corresponding to the length of said bracket minus the width of one of said flanges for allowing retraction of said plate from said bracket when said plate is pushed in the direction of the other of said flanges, resilient means mounted on said bracket under said other flange for biasing said plate in the direction of said one flange and, pedestal means fixed on said plate adapted to support a signalling post, wherein said post is removable from said bracket and said ground retaining foundation.

2. A disconnectable base support assembly for roadway as recited in claim 1, wherein said other flange is longer than the one flange.

3. A disconnectable base support assembly for roadway as recited in claim 2, wherein the resilient means is a spring comprising a curved leaf spring extending under said other flange, said leaf spring adapted to firmly abut said plate in the direction and under said one flange within said bracket.

4. A disconnectable base support assembly for roadway as recited in claim 3, wherein said bracket is anchored in a block member adapted to be molded in said ground retaining foundation.

5. A disconnectable base support assembly for roadway as recited in claim 3, wherein said pedestal means is a brace member secured on said plate, said brace member covering an area on said plate leaving a margin adjacent the flanges corresponding in width substantially to the width of each flange under which it is superposed, said brace member adapted to hold a signalling post.

6. A disconnectable base support assembly for roadway as recited in claim 5, comprising an elastomeric membrane surroundingly fixed to said brace member, said membrane having a periphery for covering said bracket.

7. A disconnectable base support assembly for roadway as recited in claim 5, comprising a platform embedding said flat face and said flanges, for holding said bracket, said platform being made of weighted synthetic rubber for limiting the displacement of platform when the post is hit by a vehicle.

* * * * *